US005407161A

United States Patent [19]

Mulkeran

[11] Patent Number: 5,407,161

[45] Date of Patent: Apr. 18, 1995

[54] BRACKET TO BE SECURED TO A CYLINDRICAL OBJECT

[75] Inventor: Kevin D. Mulkeran, Sterling Hgts., Mich.

[73] Assignee: Valeo Engine Cooling, Inc., Rochester Hills, Mich.

[21] Appl. No.: 36,927

[22] Filed: Mar. 25, 1993

[51] Int. Cl.[6] ..... A47G 29/02

[52] U.S. Cl. ..... 248/232; 165/67; 180/68.4; 248/231.8

[58] Field of Search ..... 248/231.8, 316.7, 316.5, 248/213.3, 232; 165/67; 24/457; 180/68.4

[56] References Cited

U.S. PATENT DOCUMENTS

| | | | |
|---|---|---|---|
| 4,579,184 | 4/1986 | Hiramoto | 248/232 X |
| 5,069,275 | 12/1991 | Suzuki | 165/67 |
| 5,127,466 | 7/1992 | Ando | 165/67 |
| 5,183,103 | 2/1993 | Tokutake | 180/68.4 X |
| 5,205,349 | 4/1993 | Nagao | 165/67 |
| 5,240,068 | 8/1993 | Tokutake | 248/232 |
| 5,291,961 | 3/1994 | Attinger | 180/68.4 |

FOREIGN PATENT DOCUMENTS

| | | | |
|---|---|---|---|
| 5087483 | 4/1993 | Japan | 165/67 |
| 153119 | 1/1956 | Sweden | 165/67 |

*Primary Examiner*—J. Franklin Foss
*Attorney, Agent, or Firm*—Morgan & Finnegan

[57] ABSTRACT

A two-part bracket to be secured to a cylindrical object such as a header tank for a condenser, e.g. for an automobile air conditioning system, comprises two parts each having a concave portion and a flange portion and interengaging formations such as matching tongues and grooves arranged so that the two parts can be assembled with their concave portions together embracing an arc of more than 180° around a portion of the cylindrical object and with their flange portions lying against one another so as to resist opening of the region embraced by the concave portions, so that the assembled bracket can be slid on to the cylindrical object from one end and will be held thereon in a desired position by friction while the bracket is welded or brazed to the cylindrical object.

7 Claims, 2 Drawing Sheets

BRACKET TO BE SECURED TO A CYLINDRICAL OBJECT

FIELD OF THE INVENTION

This invention relates to brackets adapted to be secured to cylindrical objects, such as the header tanks of condensers, e.g. for use in automobile air conditioning systems.

BACKGROUND OF THE INVENTION

It is advantageous to be able to secure brackets to such objects by welding or brazing, e.g. during the manufacturing process in which the header tank is welded or brazed to a condenser core. A problem arises in that the bracket must normally be secured to the object by wire or a specially designed fixture before the assembly is subjected to the welding or brazing process, and the wire or fixture can involve lengthy set-up times and can impede the welding process. It may also be necessary to remove the wire or fixture after the welding or brazing has been completed.

DISCUSSION OF THE INVENTION

It is an object of the present invention to provide a bracket which will be easily assembled and can readily be welded or brazed to a cylindrical object without the use of additional fixing means.

In accordance with the present invention, a bracket for securing to a cylindrical object, such as a header tank for a condenser, comprises two parts each of which has a respective concave portion adapted to embrace a portion of the cylindrical object from a respective side thereof and a respective flange portion extending away from the concave portion, and interengaging formations provided on the concave has a respective concave portion adapted to embrace a portion of the cylindrical object from a respective side thereof and a respective flange portion extending away from the concave portion, and interengaging formations provided on the concave portions of the two parts of the bracket, said interengaging formations being shaped and disposed so that the two parts can be assembled with their concave portions together embracing an arc of more than 180° and with their flange portions lying against one another, thereby to resist relative movement of the parts which would enlarge the region embraced by the concave portions.

With this arrangement, the bracket can be dimensioned so that, when assembled, it can be slid over the cylindrical object from one end to the desired position and will grip the object frictionally to such an extent that it will remain in that position during the welding or brazing process, thus eliminating the need for fixing wires or fixtures.

The interengaging formations preferably comprise at least one slot in the concave portion of a first said part of the bracket and at least one tongue on the other said part of the bracket adapted to be received in the slot. Advantageously, the free end of the tongue is adapted to lie against the outside of the concave portion of the first part of the bracket, in the assembled condition.

In a preferred construction, the first part of the bracket has two of said slots formed respectively in upper and lower margins of a terminal section of its concave portion, and is formed with a substantially right-angled bend between the said section in which the slots are formed and its flange portion, which extends from said section of its concave portion. The other part of the bracket then preferably has two of said tongues respectively forming upper and lower sections of its concave portions, with the flange portion of said other portion extending from the middle of its concave portion. A strengthening boss may be press-formed in said first part of the bracket centrally spanning the substantially right-angle bend between its concave portion and its flange portion. Advantageously the concave portion of at least one part of the bracket is formed with apertures to permit flow of welding or brazing flux and thereby facilitate welding or brazing of the bracket to the cylindrical object.

A specific embodiment of the invention will now be described by way of example only and with reference to the accompanying drawings.

DESCRIPTION OF THE PREFERRED EMBODIMENT OF THE INVENTION

Figure 1:
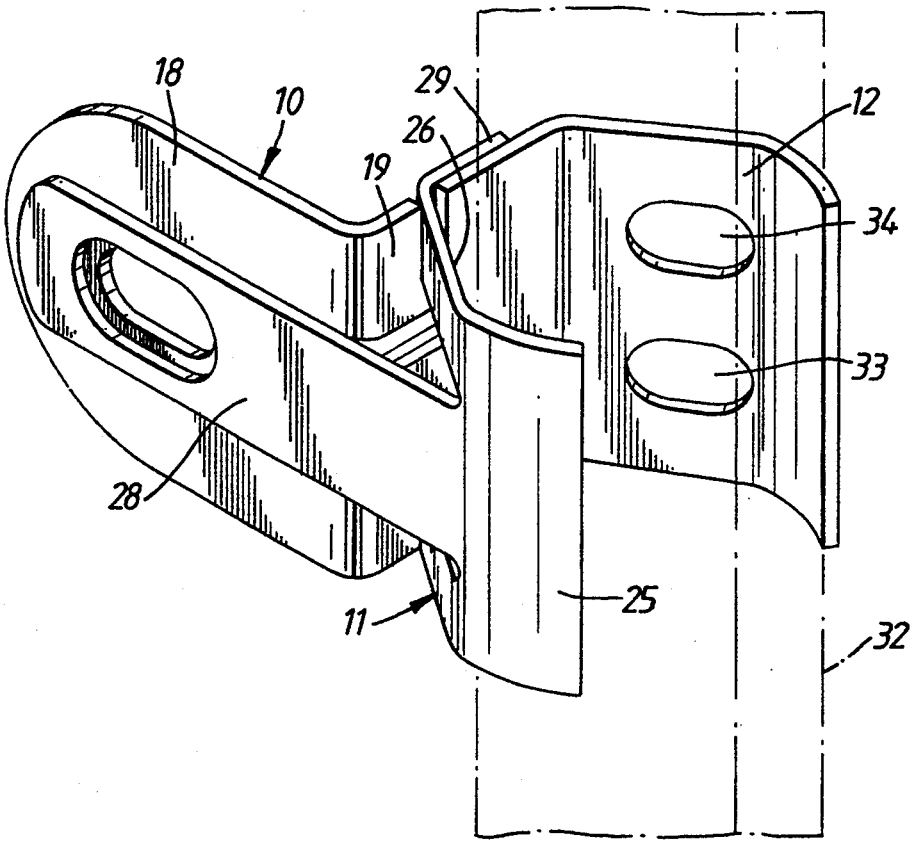
FIG. 1 is a perspective view of a two-part bracket assembled on a header tank (shown in phantom)
Figure 2:
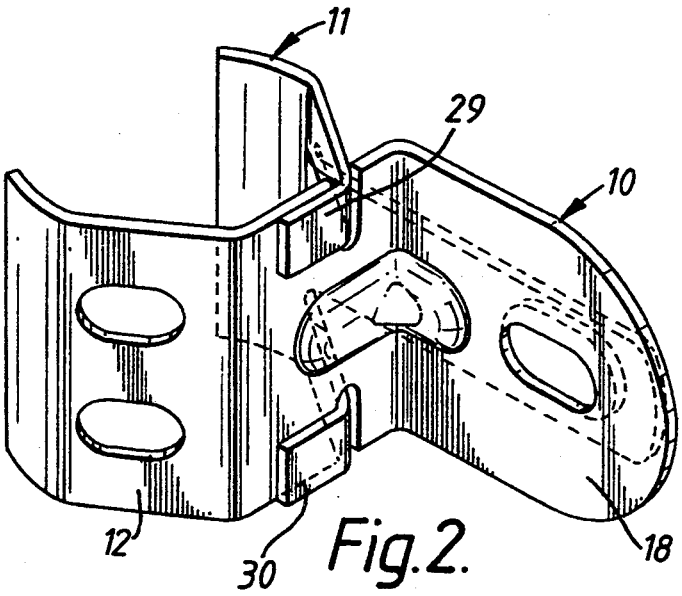
FIG. 2 is a perspective view of the assembled bracket, to a smaller scale and seen from the opposite side to that seen in FIG. 1.

The two-part bracket illustrated in the drawings is intended to be secured to the cylindrical header tank of a condenser of an automobile air conditioning system, for use in mounting the condenser in the automobile. For this purpose, the bracket is adapted to retain itself in position on the header tank, without the use of wires or fixtures, during the welding or brazing process by which the header tank is secured to the condenser core and the bracket is simultaneously secured to the header tank.

Figure 3:
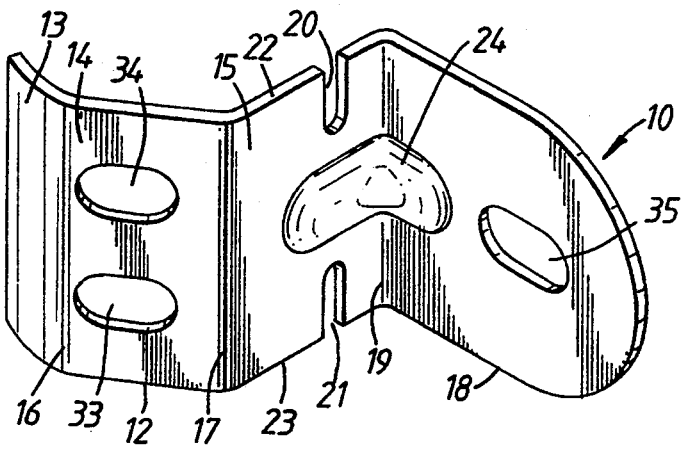
FIG. 3 is a perspective view similar to FIG. 2 of one part (referred to as the hook part) of the bracket.

The bracket illustrated comprises a first part 10 (referred to for convenience herein as the hook part) and another part 11 (referred to herein as the finger part). As best seen in FIG. 3, the hook part 10 has a concave portion 12 formed of a cylindrically curved free end section 13, a flat mid-section 14 and a flat terminal section 15, joined by respective bends 16, 17, and a flat flange portion 18 joined to the concave portion 12 by a substantially right angle bend 19. Two slots 20, 21 are formed respectively in upper and lower margins 22, 23 of the terminal section 15.

A strengthening boss 24 is press-formed in the hook part 10, centrally spanning the bend 19 so as to increase resistance to bending of the flange portion 18 relative to the concave portion 12.

Figure 4:
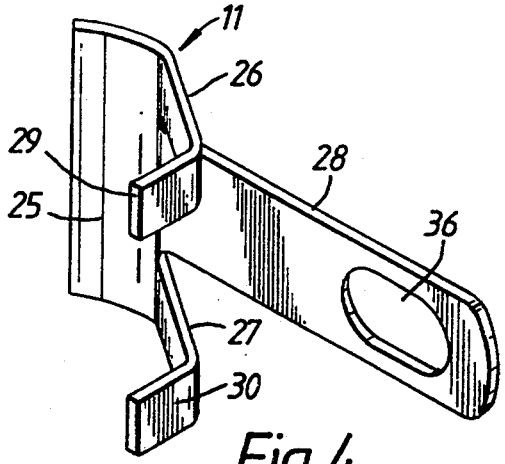
FIG. 4 is a perspective view similar to FIGS. 2 and 3 of the other part ( referred to as the finger part) of the bracket.

The finger part 11, best seen in FIG. 4, has a concave portion 25, with two tongues 26, 27 respectively forming upper and lower sections of the concave portion 25, and a flat flange portion 28 extending from the middle of the concave portion 25. The slots 20, 21 in the hook part 10 are dimensioned so as to be capable of receiving the tongues 26, 27 of the finger part 11.

Figure 5:
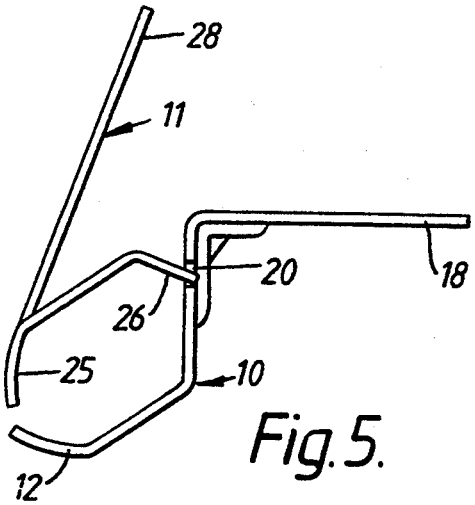
FIGS. 5, 6, and 7 are plan views showing three stages in the assembly of the two parts of the bracket.
Figure 6:
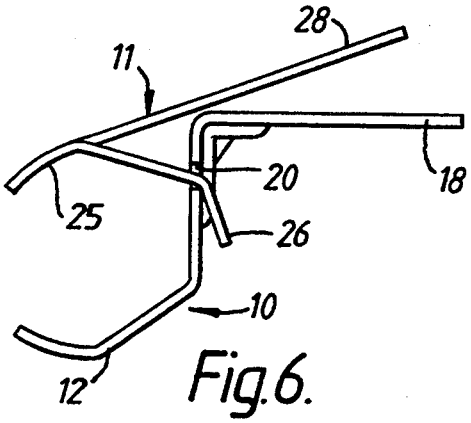
Figure 7:
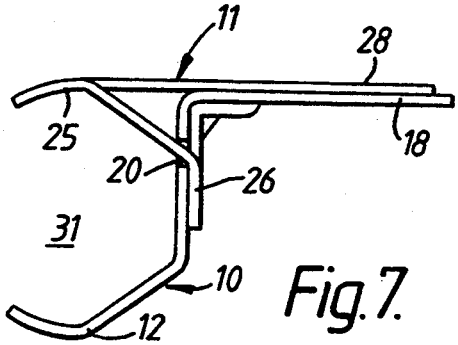

The hook part 10 and finger part 11 can be assembled as shown in FIGS. 5, 6 and 7, by inserting the free ends 29, 30 of tongues 26, 27 of the finger part into the slots 20, 21 of the hook part (FIG. 5), then rotating the finger part 11 relative to the hook part 10 as the tongues are further passed through the slots (FIG. 6) until the free ends 29, 30 of the tongues come to lie against the outside of the concave portion 12 of the hook portion 10 and the flange portion 18 of the hook part (FIG. 7). In this assembled condition, the concave portions 12 and 25 together embrace an arc of more than 180°. The flange portions 18 28 lying against one another resist further relative movement of the parts 10, 11 which would enlarge the region 31 (FIG. 7) embraced by their concave portions 12, 25.

The assembled bracket 10, 11 can then be slid over the cylindrical header tank 32 (shown in phantom in FIG. 1) from one end to the desired position, where it is held by friction without the use of wire or fixtures during the subsequent welding or brazing process.

Slots 33, 34 may be provided in the concave portion 12 of the hook part 10, and possibly in the concave portion 25 of the finger part 11, to permit welding or brazing flux to flow into contact with the surface of the tank 32 and thereby improve the attachment of the bracket.

The flange portions 18, 28 are also provided with slots 35, 36, respectively, to permit passage of attachment means such as bolts for mounting the condenser in an automobile. As illustrated, the slot 35 in flange portion 18 on the hook part 10 is dimensioned to match the diameter of the mounting bolt while slot 36 in flange portion 28 on the finger part 11 is larger to provide clearance allowing for possible misalignment of the two flange parts.

The bracket described above can be securely attached to the condenser header tank, without the use of wires or fixtures, in the welding or brazing process by which the header tank and core are secured together, without requiring a separate process step and without interfering with the performance of the process.

What is claimed is:

1. A bracket for securing to a cylindrical object such as a header tank for a condenser, the bracket comprising two parts each of which has a respective concave portion adapted to embrace a portion of the cylindrical object from a respective side thereof to encompass through an arc of more than 180° around the cylindrical object and secure the cylindrical object between the two bracket parts and a respective flange portion extending away from the concave portion, and interengaging formations provided on the concave portions of the two parts of the bracket, said interengaging formations being shaped and disposed so that the two parts can be assembled with their concave portions together embracing the arc of more than 180° and with their flange portions lying against one another, thereby to resist relative movement of the parts which would enlarge the region embraced by the concave portions.

2. A bracket according to claim 1, wherein the concave portion of at least one part of the bracket is formed with apertures to permit flow of welding or brazing flux and thereby facilitate welding or brazing of the bracket to the cylindrical object.

3. A bracket for securing to a cylindrical object such as a header tank for a condenser, the bracket comprising two parts each of which has a respective concave portion adapted to embrace a portion of the cylindrical object from a respective side thereof and a respective flange portion extending away from the concave portion, and interengaging formations provided on the concave portions of the two parts of the bracket, said interengaging formations being shaped and disposed so that the two parts can be assembled with their concave portions together embracing an arc of more than 180° and with their flange portions lying against one another, thereby to resist relative movement of the parts which would enlarge the region embraced by the concave portions, wherein the interengaging formations have at least one slot in the concave portion of the first said part of the bracket and at least one tongue on the other said part of the bracket adapted to be received in the slot.

4. A bracket according to claim 3, wherein the free end of the tongue is adapted to lie against the outside of the concave portion of the first part of the bracket, in the assembled condition.

5. A bracket according to claim 4, wherein the first part of the bracket has two of said slots formed respectively in upper and lower margins of a terminal section of its concave portion, and is formed with a substantially right-angled bend between the said section in which the slots are formed and its flange portion, which extends from said section of its concave portion.

6. A bracket according to claim 5, wherein the other part of the bracket has two of said tongues respectively forming upper and lower sections of its concave portions, with the flange portion of said other portion extending from the middle of its concave portion.

7. A bracket according to claim 6 wherein a strengthening boss is press-formed in said first part of the bracket centrally spanning the substantially right-angle bend between its concave portion and its flange portion.

* * * * *